United States Patent [19]

Johnson

[11] 4,054,259

[45] Oct. 18, 1977

[54] WALER-STIFFBACK BRACKET

[76] Inventor: Calvin R. Johnson, 2711 Winston Ave., Las Cruces, N. Mex. 88001

[21] Appl. No.: 687,382

[22] Filed: May 14, 1976

[51] Int. Cl.[2] ..... E04G 17/02

[52] U.S. Cl. ..... 249/219 W; 249/46

[58] Field of Search ..... 249/40–46, 249/190–191, 213–214, 216–217, 219 W; 248/205 R

[56] References Cited

U.S. PATENT DOCUMENTS

| | | | |
|---|---|---|---|
| 1,970,547 | 8/1934 | Anderson | 249/45 |
| 2,442,292 | 5/1948 | Hart | 249/46 |
| 3,128,525 | 4/1964 | Kay | 249/217 |
| 3,363,877 | 1/1968 | Gates | 249/190 |
| 3,589,666 | 6/1971 | Kirby | 249/213 |

FOREIGN PATENT DOCUMENTS

| | | | |
|---|---|---|---|
| 637,471 | 2/1962 | Canada | 249/214 |

*Primary Examiner*—Richard B. Lazarus
*Assistant Examiner*—John McQuade
*Attorney, Agent, or Firm*—Clarence A. O'Brien; Harvey B. Jacobson

[57] ABSTRACT

A bracket is provided including first and second elongated upper horizontal and lower upstanding flanges joined at adjacent inner and upper ends. The outer end of the first horizontal flange terminates in an upstanding waler retaining flange and the upper end of the waler retaining flanges terminates in an outwardly directed horizontal extension flange. The second upstanding flange is provided with an opening formed therethrough closely below the horizontal flange and rod tensioning structure is supported from the waler retaining flange on the outer side thereof for engaging and tensioning a rod projecting through the opening. Further, the outer end of the extension flange includes a transverse marginal edge portion whose opposite ends are provided with vertical openings formed therethrough and a stiffback camming structure is provided and includes hooked portions removably engaged in the openings formed through the extension flange and is operable, in a first form thereof, to cam a single stiffback into tight abutting engagement with the outer end of the extension flange. A second form of stiffback camming structure is operable to cam a pair of stiffbacks against the outer side of a waler retained in position by means of the waler retaining flange.

21 Claims, 12 Drawing Figures

WALER-STIFFBACK BRACKET

BACKGROUND OF THE INVENTION

When constructing concrete forms a contractor has in the past been forced to use different types of brackets for piecemeal forms, gang forms, five thousand pound forms and three thousand pound forms. In addition, in some different lengths of ties are required when stiffbacks are utilized. Accordingly, a considerable inventory of different types of brackets and different length ties must be maintained at all times representing a considerable expense.

BRIEF DESCRIPTION OF THE INVENTION

The waler and stiffback bracket of the instant invention has been specifically designed to be used either with walers alone, walers and single stiffbacks and walers used in conjunction with double stiffbacks. Further, the bracket is constructed in a manner whereby the same length ties may be used in each instance.

The main object of this invention is to provide a universal type of bracket designed to utilize only one length of tie in substantially all applications of the bracket.

Another object of this invention, in accordance with the immediately preceding object, is to provide a bracket instructed in a manner whereby stiffbacks may be used in conjunction therewith by means of a single stiffback clamp of conventional design.

Yet another object of this invention is to provide a clamp which may be utilized in conjunction with double stiffbacks by using a specially designed double stiffback clamp.

A final object of this invention to be specifically enumerated herein is to provide a bracket in accordance with the preceding objects and which will confrom to conventional forms of manufacture, be of simple construction and easy to use so as to provide a device that will be economically feasible, longlasting and relatively trouble free in operation.

These together with other objects and advantages which will become subsequently apparent reside in the details of construction and operation as more fully hereinafter described and claimed, reference being had to the accompanying drawings, forming a part hereof, wherein like numerals refer to like parts throughtout.

DETAILED DESCRIPTION OF THE INVENTION

Figure 1:
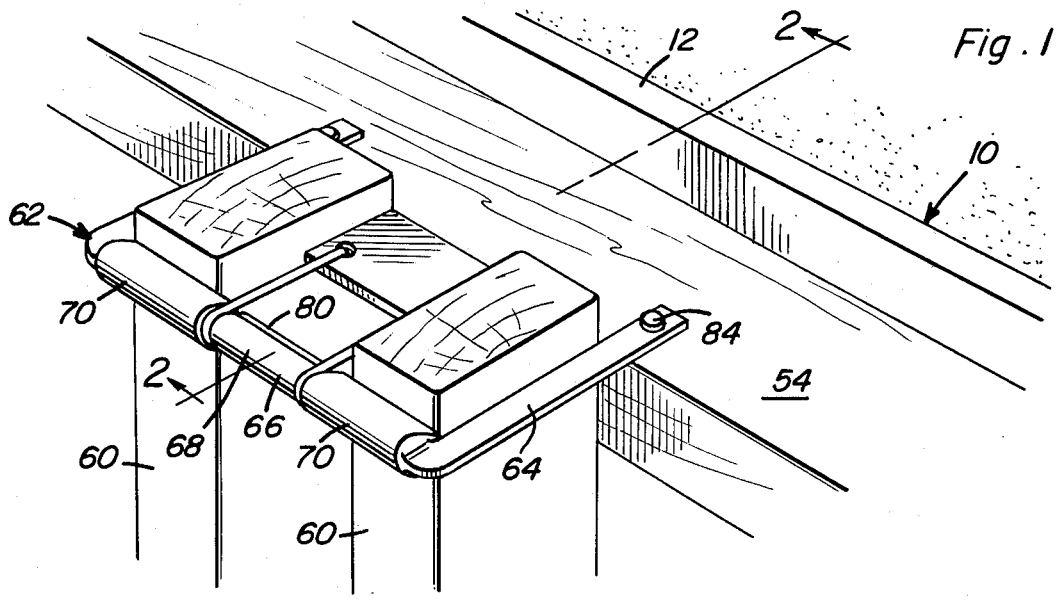
FIG. 1 is a fragmentary, prospective view of the bracket of the instant invention utilized in a double stiffback installation through the use of a special double stiffback clamp.
Figure 2:
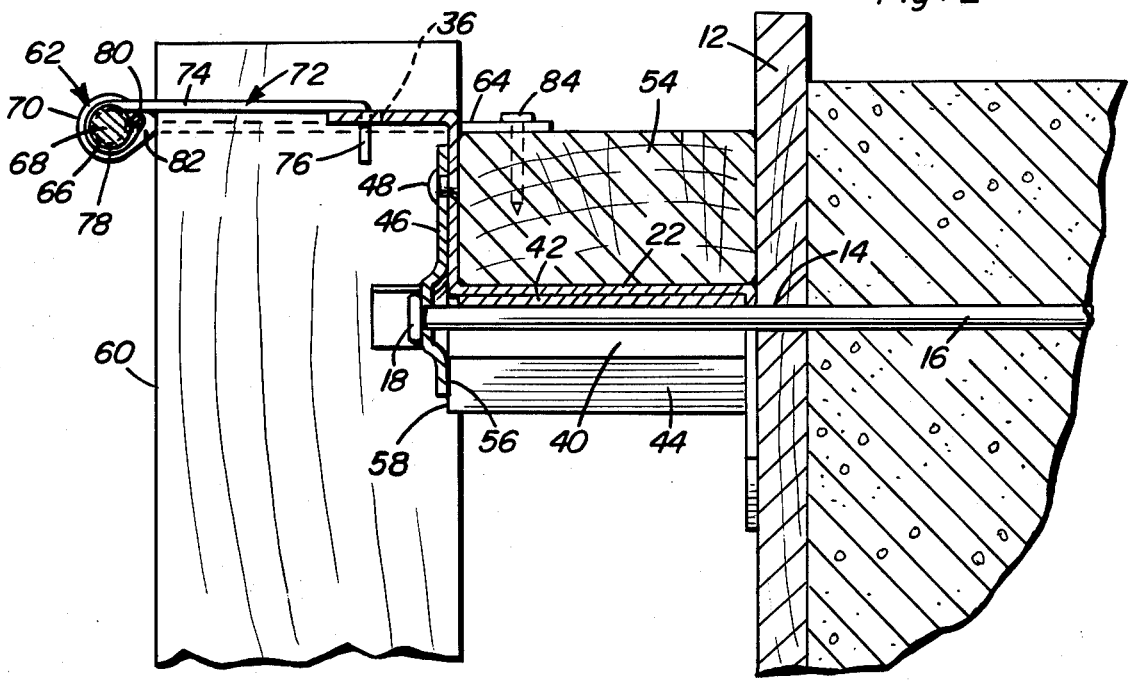
FIG. 2 is an enlarged fragmentary vertical sectional view taken substantially upon the plane indicated by the section line 2—2 of FIG. 1.
Figure 3:
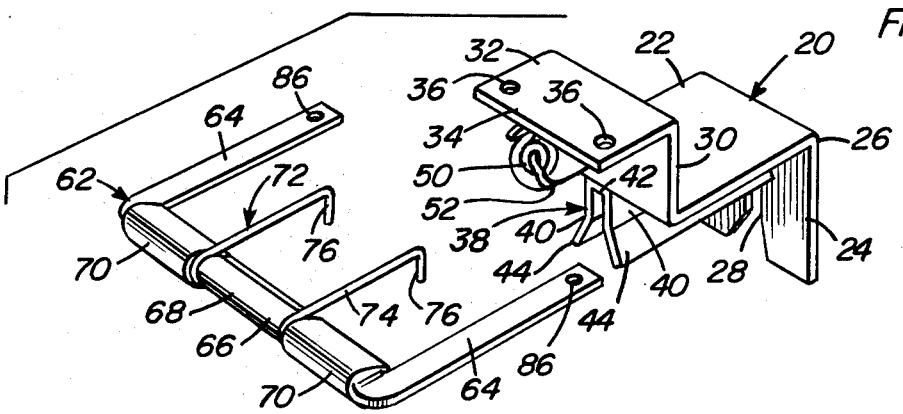
FIG. 3 is an exploded prospective view of the bracket illustrated in FIGS. 1 and 2.

Referring now more specifically to the drawings the numeral 10 generally designates a concrete form including an outer wall 12. The wall 12 has an opening 14 formed therethrough and a rod 16 including an enlarged outer end 18 projects through the opening 14.

A first form of bracket is referred to in general by the reference numeral 20 and includes first and second upper horizontal and lower vertical flanges 22 and 24 joined as at 26 at adjacent ends. The flange 24 includes a vertical downwardly opening slot 28 formed therein and the upper end of the slot defines an opening immediately beneath the flange 22 which in alignment with the opening 24 when the bracket 20 is applied to the wall 12.

The outer end of the flange 22 terminates in an upwardly directed waler retaining flange 30 and the upper end of the flange 30 terminates in an outwardly directed extension flange 32 whose outer end includes a transverse marginal portion 34 whose opposite ends are provided with vertical openings 36 formed therethrough.

Figure 4:
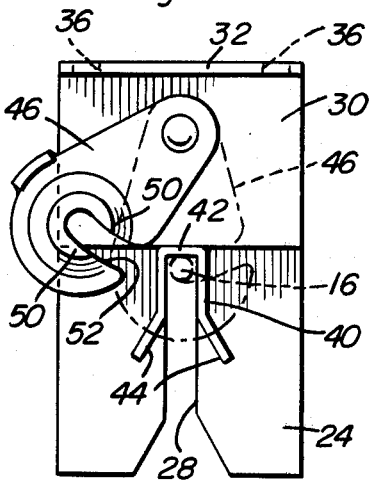
FIG. 4 is a front elevational view of the bracket illustrated in FIGS. 1 through 3.

A downwardly opening inverted channel member referred to in general by the reference numeral 38 includes a pair of depending legs 40 interconnected at the upper edge portions by means of a bight portion 42 and the bight portion 42 underlies and is secured to the flange 22 in any convenient manner such as by spot welding, rivets or other means. The lower ends of the legs 40 include outwardly and downwardly divergent lower marginal portions 44 and the inner end of the channel member 38 abuts against the outer side of the flange 24 while the outer end of the channel member 38 is substantially coplanar with the outer surface of the waler retaining flange 30. A pivoted and slotted cam 46 is oscillatably supported from the retaining flange 30 by means of a suitable pivot fastener 48 and the slot portion of the cam 46 includes cam surfaces 50 on opposite sides of the slot 52 which are engageable beneath the head 18 of the rod 16 to tension the latter as the cam 46 is swung from the inoperative solid line position thereof in FIG. 4 to the operative phantom line position of FIG. 4. Thus, with a waler 54 supported on the upper surface of the flange 22 between the retaining flange 30 and the wall 12 the cam 46 may be utilized to tension the rod 16. Further, it will be noted that the outer free end portion of the cam 46 includes inner surfaces 56 which engage the outer end 58 of the channel member 38 and thereby function to transfer the tension forces applied to the rod 16 by the cam 46 directly through the channel member 38 to the flange 24.

In the installation illustrated in FIGS. 1 through 5 a pair of stiffbacks 60 are disposed on opposite sides of the clamp 20 and a U-shaped frame referred to in general by the reference numeral 62 is provided including a pair of generally parallel arms 64 interconnected at one pair of corresponding ends by means of a transverse member 66 extending therebetween. The transverse member 66 includes a central portion 68 and opposite ends portion 70. The central portion 68 has an anchor rod structure referred to in general by the reference numeral 72 supported therefrom. The anchor rod structure 72 includes a pair of horizontal rod arms 74 including downturned ends 76 on one pair of corresponding ends and loops 78 on the other pair of corresponding ends coiled almost completely about the opposite ends of the central portion 68 of the transverse member 66. The ends of the loops 78 remote from the end portion 76 are interconnected by means of an integral portion 80 extending along the central portion 68. The opposite end portions 70 of the transverse member 66 are diametrically enlarged relative to the central portion 68 and include cam portions 82 which project in the same direction in which the arms 74 project and are engageable with the outer sides of the stiffbacks 60 when the arms 64 are swung from vertical positions to the horizontal position thereof illustrated in FIG. 1 overlying and secured to the waler 54 by means of suitable fasteners 84 past through apertures 86 in the free ends of the arms 64 and secured in the waler 54. However, it will be noted from FIG. 2 of the drawings that the length of the rod or tie 16 is not increased due to the use of the double stiffbacks 60 and that the same length rod 16 may be used in the event the double stiffbacks 60 are not used in conjunction with the bracket 20. Further, it will be noted from FIGS. 2 and 4 of the drawings that the outer end of the rod 16 passes through the inverted channel member 38 and may be laterally upwardly displaced, relatively, into position passing through the channel member 38.

Figure 6:
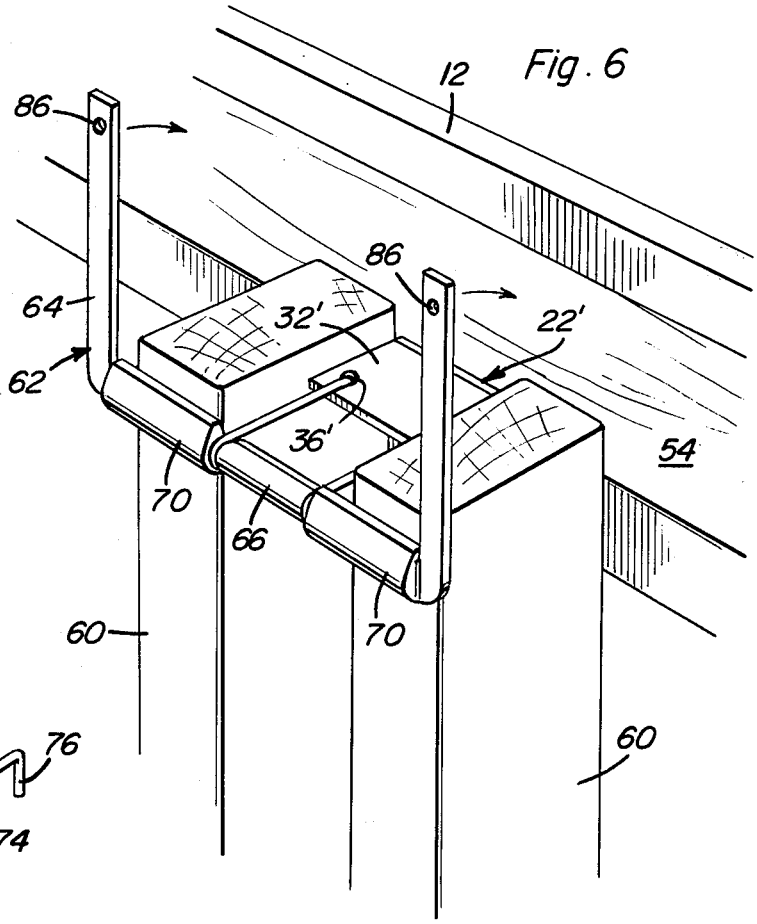
FIG. 6 is a fragmentary prospective view similar to FIG. 1 but with the double stiffback clamp in the release position.
Figure 5:
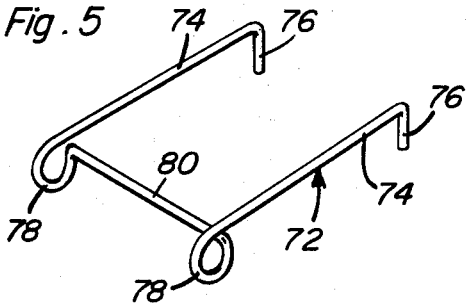
FIG. 5 is a prospective view of the anchor rod portion of the double stiffback clamp utilized in conjunction with the bracket illustrated in FIGS. 1 through 3.
Figure 7:
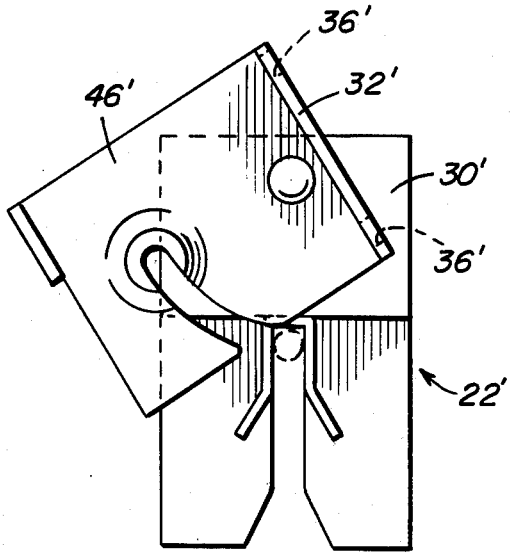
FIG. 7 is a front elevational view of a modified form of clamp.
Figure 8:
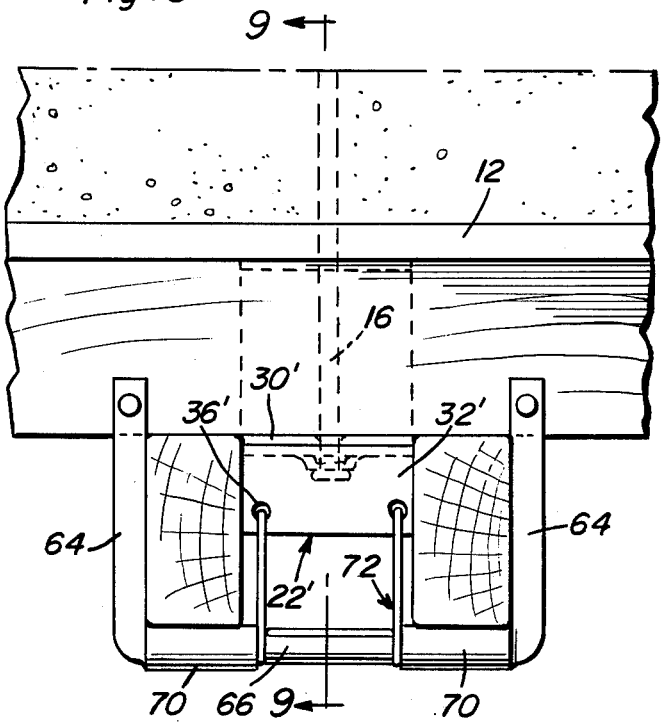
FIG. 8 is a top plane view of the modified form of clamp utilized in a double stiffback installation.
Figure 9:
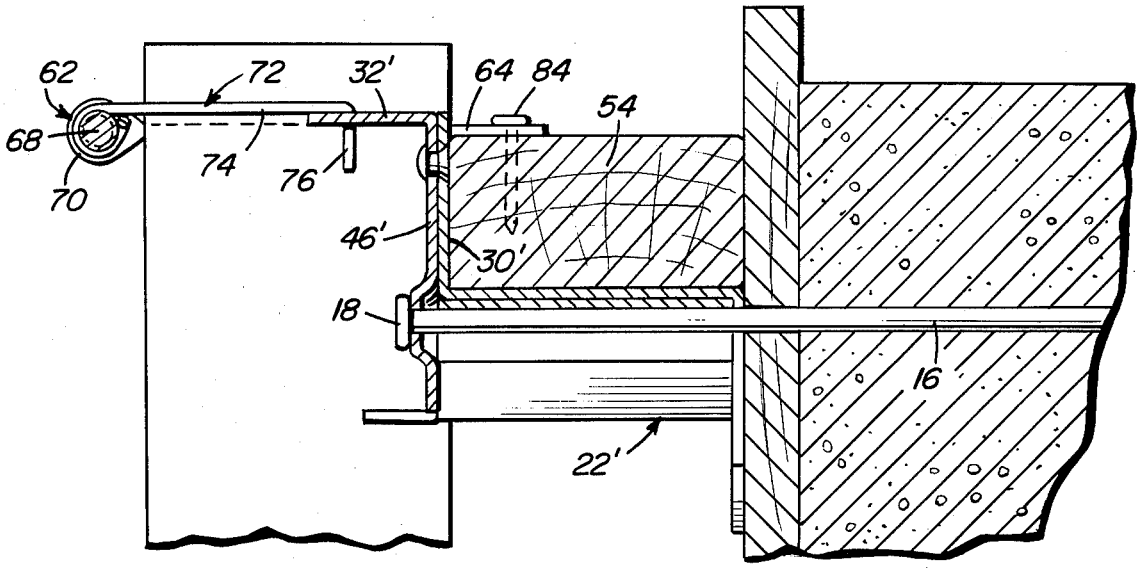
FIG. 9 is a fragmentary enlarged vertical sectional view taken substantially upon the plane indicated by the section line 9—9 of FIG. 8.

With attention now invited more specifically to FIGS. 6 through 9 of the drawings, it may be seen that the frame 62 illustrated in FIGS. 6, 8 and 9 is utilized in conjunction with a modified form of bracket referred to in general by the reference numeral 22′ and which is substantially identical to the bracket 22 except that the waler retaining flange 30′ of the bracket 22′ does not include an equivalent to the extension flange 32. Rather, the upper portion of the cam 46′ corresponding to the cam 46 includes a horizontally outwardly directed flange 32′ which corresponds to and serves the purpose of the flange 32, the flange 32′ including apertures or openings 36′ corresponding to the openings 36. Thus, the bracket 22′ may be used in substantially the same manner as the bracket 22.

Figure 10:
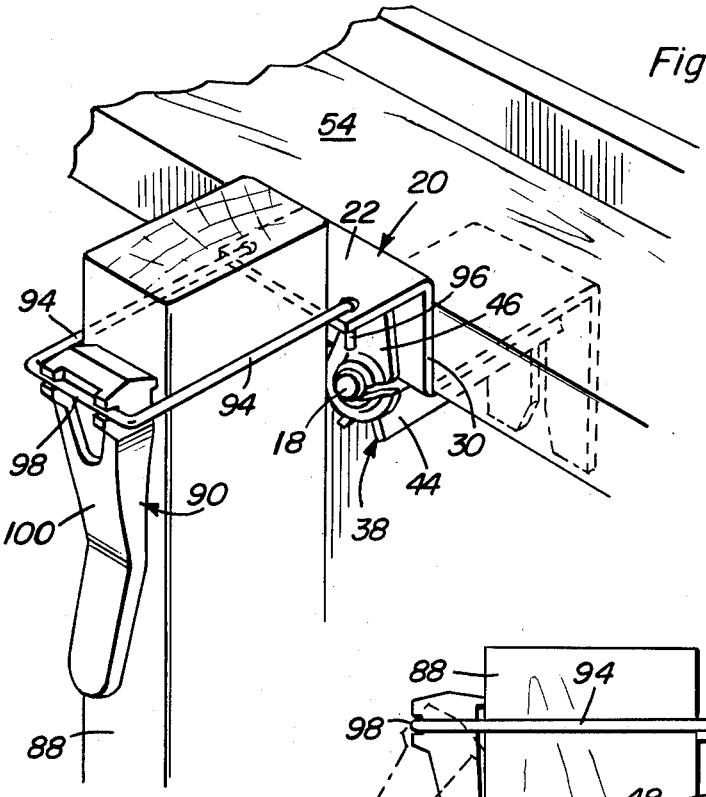
FIG. 10 is a fragmentary prospective view of the bracket utilized in a single stiffback installation whereby a conventional single stiffback clamp is used in conjunction with the bracket.
Figure 11:
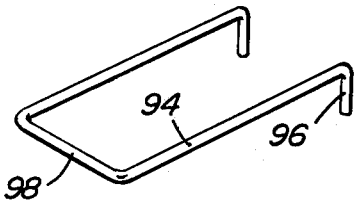
FIG. 11 is a prospective view of the anchor rod portion of the single stiffback clamp illustrated in FIG. 10.
Figure 12:
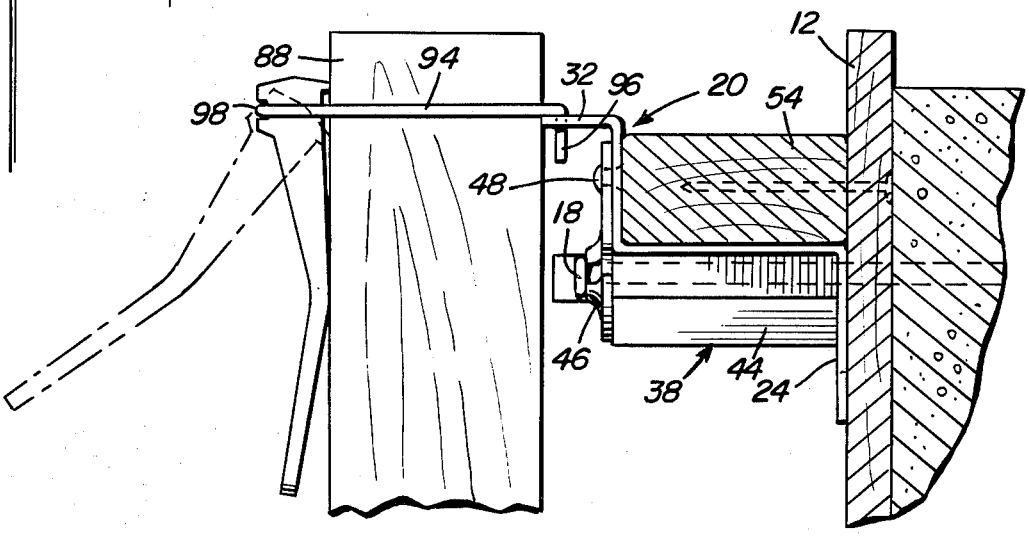
FIG. 12 is a side elevational view of the assemblage illustrated in FIG. 10 with a release position of the single stiffback clamp illustrated in phantom lines and the associated form and wearer illustrated in vertical section.

With attention now invited more specifically to FIGS. 10 through 12 of the drawings, it may be seen that the bracket 20 may also be utilized in conjunction with a single stiffback 88 through the utilization of a conventional single stiffback cam structure referred to in general by the reference numeral 90. The cam structure 90 includes rodlike arms 94 corresponding to the arms 74 and including downturned free end portions 96 corresponding to the end portions 76. The end portions of the arms 94 remote from the end portions 96 are interconnected by means of a bight portion 98 and a cam lever 100 is oscillatably supported from the bight portion 98. Accordingly, it may be seen that the lever 100 may be utilized to tightly cam the single stiffback 88 into abuting engagement with the outer end of the extension flange 32 of the bracket 20 when a single stiffback 88 is utilized in conjunction with the bracket 20.

The foregoing to considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A waler and stiffback bracket including a first elongated upper horizontal flange and a second lower upstanding flange, said flanges being joined at adjacent inner and upper ends thereof, respectively, the outer end of said first horizontal flange terminating in an upstanding waler retaining flange, said second flange including an opening formed therethrough closely below said first flange for receiving a horizontal tie rod therethrough, and rotary cam means supported from said waler retaining flange on the outer side thereof for angular displacement about an axis generally normal to said waler retaining flange, said cam means including a cam portion thereof swingable into position below said first flange and including cam surfaces for engaging a head portion on the end of said rod projecting through said opening, an elongated horizontal abutment member supported from and extending lengthwise beneath said first flange and registered with said opening, one end of said abutment member being abutted against the adjacent side of said second flange and the other end of said abutment member being at least substantially coplanar with the outer side of said waler retaining flange, said other end of said abutment member and said cam portion including coacting thrust bearing surfaces for transferring tension forces applied to said rod by said cam means directly lengthwise through said abutment member to said second flange, said first, second and waler retaining flanges comprising first end, intermediate and second end sections of a single elongated metal strap member oppositely right angularly oriented along transverse zones spaced along said strap member.

2. The combination of claim 1 wherein said second flange has a longitudinal extending downwardly opening slot formed therein, the upper portion of said slot defining said opening, said abutment member being defined by a downwardly opening channel member upwardly into which said rod is laterally receivable.

3. The combination of claim 2 wherein said channel member includes a pair of depending opposite side longitudinal flanges interconnected at their upper ends by means of an upper bight portion secured to the underside of said first flange.

4. The combination of claim 3 wherein the lower marginal edges of said depending longitudinal flanges are outwardly flared so as to be downwardly divergent.

5. A waler and stiffback bracket including a first elongated upper horizontal flange and a second lower upstanding flange, said flanges being joined at adjacent inner and upper ends thereof, respectively, the outer end of said first horizontal flange terminating in an upstanding waler retaining flange, said second flange including an opening formed therethrough closely below said first flange for receiving a horizontal tie rod therethrough, and rod tensioning means supported from said waler retaining flange on the outer side thereof for engaging and tensioning a rod projecting through said opening, an elongated horizontal abutment member supported from and extending lengthwise beneath said first flange and registered with said opening, one end of said abutment member being abutted against the adjacent side of said second flange and the other end of said abutment member being at least substantially coplanar with the outer side of said waler retaining flange, said other end of said abutment member and said rod tensioning means including coacting thrust bearing surfaces for transferring torsional forces applied to said rod by said tensioning means lengthwise through said abutment member to said second flange, said first, second and waler retaining flange comprising first end, intermediate and second end sections of a single elongated metal sharp member oppositely right angularly oriented along transverse zones spaced along said strap member.

6. The combination of claim 5 wherein said second flange has a longitudinal extending downwardly opening slot formed therein, the upper portion of said slot defining said opening, said abutment member defining a downwardly opening full length slot therein upwardly through which said rod is laterally receivable

7. The combination of claim 6 wherein said abutment member is defined by an elongated downwardly opening channel member including a pair of depending opposite side longitudinal flanges interconnected at their upper ends by means of an upper light portion secured to the underside of said first flange.

8. A waler and stiffback bracket including a first elongated upper horizontal flange and a second lower upstanding flange, said flanges being joined at adjacent inner and upper ends thereof, respectively, the outer end of said first horizontal flange terminating in an upstanding waler retaining flange, said second flange including an opening formed therethrough closely below said first flange for receiving a horizontal tie rod therethrough, and rod tensioning means supported from said waler retaining flange on the outer side thereof for engaging and tensioning a rod projecting through said opening, the upper end of said waler retaining flange terminating in an outwardly directed horizontal extension flange, the outer transverse marginal edge portion of said extension flange including opposite end portions defining anchor portions thereon, and a stiffback clamp including a horizontal U-shaped frame including a pair of parallel legs interconnected at one pair of corresponding ends by means of a bight portion extending therebetween and spaced horizontally outwardly from said outer transverse marginal edge portion, the other pair of corresponding ends of said legs including anchor means removably engaged with said anchor portions, a cam lever having one end rotatably engaged with said bight portion and including a cam surface for engaging and caming a stiffback disposed between said legs into tight abutting engagement with the outer end of said extension flange.

9. The combination of claim 8 wherein said rod tensioning means includes rotary cam means supported from said waler retaining flange for angular displacement about an axis generally normal to said waler retaining flange, said cam means including a cam portion thereof swingable into position below said first flange and including cam surfaces for engaging a head portion on the end of a rod projecting through said opening.

10. The combination of claim 9 including an elongated horizontal abutment member supported from and extending lengthwise beneath said first flange and registered with said opening, one end of said abutment member being abutted against the adjacent side of said second flange and the other end of said abutment member being at least substantially coplanar with the outer side of said waler retaining flange, said other end of said abutment member and said cam portion including coacting thrust bearing surfaces for transferring tension applied to said rod by said cam means directly lengthwise through said abutment member to said second flange.

11. The combination of claim 8 wherein said opposite end portions of said outer transverse marginal edge portion of said extension flange include vertical openings formed therethrough defining said anchor portions and said anchor means comprise downturned terminal ends on said other pair of ends of said legs removably received in said vertical openings.

12. A waler and stiffback bracket including a first elongated upper horizontal flange and a second lower upstanding flange, said flanges being joined at adjacent inner and upper ends thereof, respectively, the outer end of said first horizontal flange terminating in an upstanding waler retaining flange, said second flange including an opening formed therethrough closely below said first flange for receiving a horizontal tie rod therethrough, and rod tensioning means supported from said waler retaining flange on the outer side thereof for engaging and tensioning a rod projecting through said opening, the upper end of said waler retaining flange terminating in an outwardly directed horizontal extension flange, the outer transverse marginal edge portion of said extension flange including opposite end portions defining anchor portions thereon, and a double stiffback clamp comprising a U-shaped frame including a pair of generally parallel arms interconnected at one pair of corresponding ends by means of a transverse member extending therebetween and spaced horizontally outwardly from said outer transverse marginal edge portion, the central portion of said transverse member having elongated anchor rod means pivotally secured thereto at one end for angular displacement of said transverse member relative to said anchor rod means, the other end of said anchor rod means including anchor means removably engaged with said anchor portions, the opposite end portions of said transverse member including eccentric cam portions projecting outwardly of the side of said transverse member from which said arms project, the free ends of said arms including means for anchoring said arms to a waler supported from said first flange.

13. The combination of claim 12 wherein said anchor rod means includes a single length of rod material including a central portion extending along the central portion of said transverse member and coiled, at its opposite ends, at least partially about said transverse member.

14. The combination of claim 12 including an elongated horizontal abutment member supported from and extending lengthwise beneath said first flange and registered with said opening, one end of said abutment member being abutted, against the adjacent side of said second flange and the other end of said abutment member being at least substantially coplanar with the outer side of said waler retaining flange, said other end of said abutment member and said rod tensioning means including coacting thrust bearing surfaces for transferring tension forces applied to said rod by said rod tensioning means directly lengthwise through said abutment member to said second flange.

15. The combination of claim 14 wherein said second flange has a longitudinal extending downwardly opening slot formed therein, the upper portion of said slot defining said opening, said abutment member being defined by a downwardly opening channel member upwardly into which said rod is laterally receivable.

16. The combination of claim 12 wherein said opposite end portions of said outer transverse marginal edge portions of said extension flange include vertical openings formed therethrough defining said anchor portions and said anchor means comprise hook portions on said other end of said anchor rod means removably received in said openings.

17. The combination of claim 16 wherein said hook portions are formed integrally with said anchor rod means.

18. The combination of claim 12 wherein the effective length of the portion of said transverse member extending between said arms is sufficiently greater than the width of said extension flange to position said arms outwardly of the adjacent opposite sides of said extension flange sufficient distances to define spaces between said arms and the adjacent sides of said extension flange for receiving stiffbacks therein between the opposite end portions of said transverse member and the outer side of a waler supported from said first flange.

19. A waler and stiffback bracket including a first elongated upper horizontal flange and a second lower upstanding flange, said flanges being joined at adjacent inner and upper ends thereof, respectively, the outer end of said first horizontal flange terminating in an upstanding waler retaining flange, said second flange including an opening formed therethrough closely below said first flange for receiving a horizontal tie rod therethrough, and rod tensioning means supported from said waler retaining flange on the outer side thereof for engaging and tensioning a rod projecting through said opening, a horizontally outwardly projecting extension flange also supported from said waler retaining flange and generally horizontally registered with the upper marginal edge of said waler retaining flange, the outer transverse marginal edge portion of said extension flange including opposite end portions defining anchor portions thereon, a double stiffback clamp comprising a U-shaped frame including a pair of generally parallel arms interconnected at one pair of corresponding ends by means of a transverse member extending therebetween and spaced horizontally outwardly from said outer transverse marginal edge portion, the central portion of said transverse member having elongated anchor rod means pivotally secured thereto at one end for angular displacement of said transverse member relative to said anchor rod means, the other end of said anchor rod means including anchor means removably engaged with said anchor portions, the opposite end portions of said transverse member including eccentric cam portions projecting outwardly of the side of said transverse member from which said arms project, the free ends of said arms including means for anchoring said arms to a waler supported from said first flange.

20. The combination of claim 19 wherein said horizontally outwardly projecting extension flange is supported from the upper marginal edge portion of said waler retaining flange.

21. The combination of claim 19 wherein said horizontally outwardly projecting extension flange is supported from an upper portion of said rod tensioning means.

* * * * *